US008953992B2

(12) United States Patent
Mito et al.

(10) Patent No.: US 8,953,992 B2
(45) Date of Patent: Feb. 10, 2015

(54) FIXING DEVICE AND IMAGE FORMING APPARATUS

(71) Applicants: Ayako Mito, Miyagi (JP); Ryuichi Kikegawa, Miyagi (JP)

(72) Inventors: Ayako Mito, Miyagi (JP); Ryuichi Kikegawa, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/785,091

(22) Filed: Mar. 5, 2013

(65) Prior Publication Data

US 2013/0236220 A1 Sep. 12, 2013

(30) Foreign Application Priority Data

Mar. 7, 2012 (JP) ..... 2012-050630
Sep. 19, 2012 (JP) ..... 2012-205446

(51) Int. Cl.
*G03G 15/20* (2006.01)
*G03G 21/00* (2006.01)

(52) U.S. Cl.
CPC ..... *G03G 15/2075* (2013.01); *G03G 21/0041* (2013.01); *G03G 15/2025* (2013.01)
USPC ..... 399/327; 399/352

(58) Field of Classification Search
CPC ..... G03G 15/2025; G03G 15/2075; G03G 21/0041
USPC ..... 399/327, 352
See application file for complete search history.

(56) References Cited

U.S. PATENT DOCUMENTS

| | | | | |
|---|---|---|---|---|
| 5,168,314 | A * | 12/1992 | Gunji et al. | 399/327 |
| 6,427,060 | B1 * | 7/2002 | Arakawa et al. | 399/327 |
| 2006/0039713 | A1 | 2/2006 | Kishi et al. | |
| 2006/0051111 | A1 | 3/2006 | Kishi et al. | |
| 2006/0051112 | A1 | 3/2006 | Matsusaka et al. | |
| 2006/0051113 | A1 | 3/2006 | Kishi et al. | |
| 2006/0051119 | A1 | 3/2006 | Kishi et al. | |
| 2006/0051120 | A1 | 3/2006 | Kishi et al. | |
| 2006/0051121 | A1 | 3/2006 | Matsusaka et al. | |
| 2006/0127118 | A1 | 6/2006 | Kishi et al. | |
| 2008/0145088 | A1 | 6/2008 | Matsusaka et al. | |
| 2009/0196643 | A1 | 8/2009 | Mito et al. | |

FOREIGN PATENT DOCUMENTS

| | | |
|---|---|---|
| JP | 10-09715 | 4/1998 |
| JP | 10-333480 | 12/1998 |
| JP | 2003-255745 | 9/2003 |
| JP | 2010-072066 | 4/2010 |

* cited by examiner

*Primary Examiner* — Benjamin Schmitt
(74) *Attorney, Agent, or Firm* — Harness, Dickey & Pierce, P.L.C.

(57) ABSTRACT

A fixing device includes a fixing unit, a cleaning unit, and a controller. The fixing unit includes a pair of nipping members and a heat source that heats at least one of the pair of nipping members. The cleaning unit includes a cleaning web wound on a supply core to be supplied from the supply core and taken up on a take-up core, and a pressing roller that is pressed against one of the pair of nipping members. The controller causes the take-up core to rotate in such a manner that, when a leading portion of the cleaning web extending up to 2% of an overall length of the cleaning web from a leading end of the cleaning web is fed, a length of the cleaning web to be fed in one feeding is 10-30% larger than when a subsequent portion of the cleaning web is fed.

16 Claims, 5 Drawing Sheets

FIXING DEVICE AND IMAGE FORMING APPARATUS

CROSS-REFERENCE TO RELATED APPLICATIONS

The present application claims priority to and incorporates by reference the entire contents of Japanese Patent Application No. 2012-50630 filed in Japan on Mar. 7, 2012 and Japanese Patent Application No. 2012-205446 filed in Japan on Sep. 19, 2012.

BACKGROUND OF THE INVENTION

1. Field of the Invention

The present invention relates to a fixing device and an image forming apparatus and, more particularly, to a fixing device that includes a cleaning unit that presses an elongated cleaning web running from a supply core to a take-up core against a fixing roller of a fixing device that includes the fixing roller provided with a heat source and a pressure-applying roller that is in pressure contact with the fixing roller, thereby cleaning the fixing roller.

2. Description of the Related Art

An image forming apparatus such as a copier, a printer, or a facsimile typically employs a fixing device of a heating-roller type that fixes a not-yet-fixed toner image on a recording medium, such as transfer paper, with heat and pressure by bringing a fixing roller (i.e., a heating roller) and a pressure-applying roller into pressure contact with each other and causing the recording medium to pass through between the rollers.

Known examples of this conventional type of fixing device include a fixing device disclosed in Japanese Patent Application Laid-open No. 2003-255745. This fixing device includes a web-type cleaning unit that cleans a surface of a fixing roller by bringing the fixing roller into sliding contact with a cleaning web that is being taken up from a supply core, on which the cleaning web is wound, onto a take-up roller to prevent toner from being peeled off from transfer paper and adhering to the fixing roller (toner offset).

The web-type cleaning unit uses heat-resistant fiber such as nonwoven textile impregnated with a releasing agent such as silicone oil as the cleaning web, thereby not only wiping off toner adhering to the surface of the fixing toner with the cleaning web but also supplying the releasing agent from the cleaning web to the surface of the fixing roller. The web-type cleaning has cleaning performance superior to other type of cleaning such as roller-type cleaning that brings a cleaning member, a roller, into contact with a surface of a fixing roller or felt-type cleaning that brings a cleaning member made of felt into sliding contact with a fixing roller.

The cleaning unit of the conventional fixing device is configured to maintain cleaning performance by feeding only a minuscule length (1 mm, for example) of the cleaning web each time a predetermined number of recording sheets are subjected to fixing operation so that a new portion, which is impregnated with silicone oil, of the cleaning web is regularly brought into sliding contact the fixing roller.

However, the web-type cleaning unit of the fixing device disclosed in Japanese Patent Application Laid-open No. 2003-255745 has a disadvantage. That is, because oil seeps from an outer-radius portion of the rolled-up cleaning web and moves toward the take-up core which is a core of the cleaning web, an amount of oil absorbed and retained in the cleaning web wound on the take-up core in a roll form is large in an inner-radius portion but small in the outer-radius portion.

For example, as illustrated in FIGS. 5A and 5B, when a cleaning web has an overall length of 32 m, an amount of oil absorbed and retained in a portion of the cleaning web, which corresponds to an outer-radius portion of the cleaning web wound on a take-up core, within 0.5 m from a leading end of the cleaning web is 10% to 20% smaller than a lower threshold of a target range, while an amount of oil absorbed and retained in a portion of the cleaning web, which corresponds to an inner-radius portion of the cleaning web wound on the take-up core, within 0.5 m from a trailing end of the cleaning web is 10% to 20% larger than an upper threshold of the target range.

There is a problem in the portion of the cleaning web within 0.5 m from the leading end where the amount of oil is small. That is, because oil on the surface of the fixing roller becomes insufficient and cleaning performance is delivered insufficiently, toner offset onto the surface of the fixing roller occurs, which undesirably results in contamination of an image.

Furthermore, when toner offset onto the surface of the fixing roller occurs, the moved toner can be accumulated on a thermistor that contacts the fixing roller and undesirably damage a surface layer of the fixing roller.

There is also a problem in the portion of the cleaning web within 0.5 m from the trailing end where the amount of oil is large. That is, because oil on the surface of the fixing roller becomes excessive, toner escaping occurs, which undesirably results in contamination of an image.

Put another way, there is a problem that because oil absorbed and retained in the cleaning web is deficient in the portion near the leading end and excessive in the portion near the trailing end, the surface of the fixing roller becomes non-uniform in anti-adhesive properties.

Therefore, there is a need for a fixing device and an image forming apparatus capable of equalizing anti-adhesion properties across a surface of a fixing roller whichever portion of a cleaning web is fed to clean the surface.

SUMMARY OF THE INVENTION

According to an embodiment, there is provided a fixing device that includes a fixing unit, a cleaning unit, and a controller. The fixing unit includes a pair of nipping members that are in pressure contact with each other, and a heat source that heats at least one of the pair of nipping members, and fixes toner onto a recording medium with heat and pressure by nipping the recording medium between the nipping members. The cleaning unit includes a cleaning web wound on a supply core to be supplied from the supply core and taken up on a take-up core, and a pressing roller that is pressed by a pressure-applying member against one of the pair of nipping members, and brings the cleaning web into contact with one of the pair of nipping members using the pressing roller, thereby cleaning the one of the pair of nipping members. The controller causes the take-up core to rotate in accordance with the number of sheets of the recording medium passed through between the nipping rollers to feed the cleaning web from the supply core. The controller causes the take-up core to rotate in such a manner that, when a leading portion of the cleaning web extending up to 2% of an overall length of the cleaning web from a leading end of the cleaning web is fed, a length of the cleaning web to be fed in one feeding is 10-30% larger than when a subsequent portion of the cleaning web is fed.

According to another embodiment, there is provided a fixing device that includes a fixing unit, a cleaning unit, and a controller. The fixing unit includes a pair of nipping members that are in pressure contact with each other, and a heat source that heats at least one of the pair of nipping members, and fixes toner onto a recording medium with heat and pressure by nipping the recording medium between the nipping members. The cleaning unit includes a cleaning web wound on a supply core to be supplied from the supply core and taken up on a take-up core, and a pressing roller that is pressed by a pressure-applying member against one of the pair of nipping members, and brings the cleaning web into contact with one of the pair of nipping members using the pressing roller, thereby cleaning the one of the pair of nipping members. The controller causes the take-up core to rotate in accordance with the number of sheets of the recording medium passed through between the nipping rollers to feed the cleaning web from the supply core. The controller causes the take-up core to rotate in such a manner that, when a trailing portion of the cleaning web extending up to 2% of an overall length of the cleaning web from a trailing end of the cleaning web is fed, a length of the cleaning web to be fed in one feeding is 10-30% smaller than when a previous portion of the cleaning web is fed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
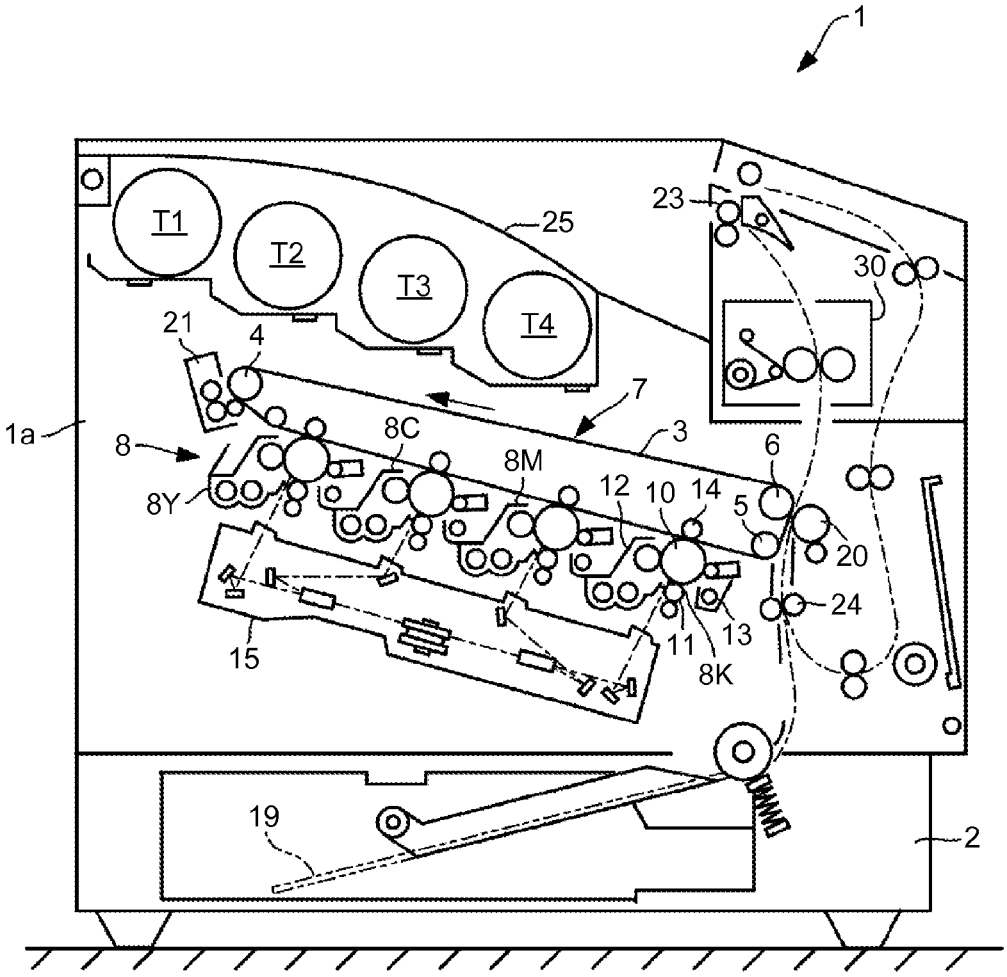
FIG. 1 is a schematic configuration diagram of an image forming apparatus according to an embodiment of the present invention.

Exemplary embodiments of the present invention are described below with reference to the accompanying drawings. FIG. 1 is a schematic configuration diagram of an image forming apparatus according to an embodiment of the present invention. The image forming apparatus is implemented as a copier.

As illustrated in FIG. 1, an image forming apparatus 1 is implemented as an electrophotographic tandem color printer (hereinafter, "printer") capable of forming a full-color image. The image forming apparatus 1 is not limited to a color printer but can be a monochrome printer, or further alternatively, a copier or a facsimile machine rather than such a printer as that illustrated in FIG. 1.

Basic configuration and operations of the image forming apparatus 1 implemented as the printer are described below with reference FIG. 1, which is followed by description of configuration and effects characterizing the present embodiment. The image forming apparatus 1 includes an apparatus main body 1*a* as an image forming device that is a primary part of the image forming apparatus 1, and a paper cassette 2 arranged below the apparatus main body 1*a* to hold therein sheets of a recording medium 19 such as transfer paper.

The apparatus main body 1*a* includes an image forming section 8, an intermediate transfer unit 7, an optical writing unit 15, and a fixing device 30. The image forming section 8 includes four image forming units, or image forming units 8Y, 8C, 8M, and 8K, each including an image carrier. The intermediate transfer unit 7 includes a plurality of rollers 4, 5, and 6 and an intermediate transfer belt 3 which is a flexible endless belt looped over the rollers 4, 5, and 6 to serve as an intermediate transfer member. The optical writing unit 15 performs optical writing as an optical writing section on an image carrier. The fixing device 30 fixes a toner image onto the recording medium 19.

The image forming units 8Y, 8C, 8M, and 8K and the intermediate transfer unit 7 are detachably mounted on the apparatus main body 1*a*.

A portion of the intermediate transfer belt 3 between the roller 4 and the roller 5 corresponds to a lower belt side of the intermediate transfer belt 3.

A secondary transfer roller 20 which is a secondary transfer device is arranged on the intermediate transfer belt 3 in a manner to face a conveying path at a portion facing the roller 6. A belt cleaning device 21 that cleans the surface of the intermediate transfer belt 3 is arranged on the intermediate transfer belt 3 at a portion facing the roller 4.

The image forming section 8 is arranged to face the lower side of the intermediate transfer belt 3, thus being positioned beneath the intermediate transfer belt 3.

Each of the image forming units 8Y, 8C, 8M, and 8K of the image forming section 8 includes, as the image carrier, a photosensitive element 10 that is in contact with the intermediate transfer unit 3.

An electrostatic charger 11, a developing device 12, and a cleaning device 13 are arranged around each of the photosensitive elements 10.

A transfer roller 14 which is a transfer unit that performs primary transfer is provided for each of the photosensitive elements 10. The transfer roller 14 is arranged inside the intermediate transfer belt 3 at a position where the photosensitive element 10 contacts the intermediate transfer belt 3.

In the present embodiment, the image forming units 8Y, 8C, 8M, and 8K are basically identical in structure, and, in FIG. 1, only elements of the representative image forming unit 8K are indicated with reference numerals and symbols.

The image forming units 8Y, 8C, 8M, and 8K differ from one another only in color of toner which is a developer stored in each of the developing devices 12.

The developing device 12 of the image forming unit 8Y, that of the image forming unit 8C, that of the image forming unit 8M, and that of the image forming unit 8K store therein yellow (Y) toner, cyan (C) toner, magenta (M) toner, and black (K) toner, respectively.

When toner in one of the developing devices 12 is consumed, toner is supplied from corresponding one of toner replenishing bottles T1, T2, T3, and T4 arranged in an upper portion of the apparatus main body 1*a*.

The optical writing unit 15 forms latent images for respective colors on the surfaces of the photosensitive elements 10 by emitting optically-modulated laser light onto the surfaces of the photosensitive elements 10. In the present embodiment, the optical writing unit 15 is arranged below the image forming section 8.

The intermediate transfer unit 7, the image forming section 8, the optical writing unit 15, and an array of the toner replenishing bottles T1, T2, T3, and T4 are arranged as being inclined in a same direction in the apparatus main body 1*a*. This arrangement makes an area occupied by these elements smaller when compared with an arrangement where these elements are arranged horizontally in the apparatus main body 1*a*.

When an image forming operation is started, each of the photosensitive elements 10 of the image forming units 8Y, 8C, 8M, and 8K is driven to rotate clockwise in FIG. 1 by a driving device (not shown), and the surface of the photosensitive element 10 is uniformly electrostatically charged by the electrostatic charger 11 so as to have a predetermined polarity.

The optical writing unit 15 emits laser light onto the charged surfaces of the photosensitive elements 10. As a result, an electrostatic latent image is formed on each of the surfaces.

Meanwhile, image data according to which exposure of each of the photosensitive elements 10 is performed is monocolor image data obtained by performing color separation on a desired full-color image into yellow, cyan, magenta, and black color data.

Each of the electrostatic latent images formed in this manner is developed into a toner image, which is a visible image, with toner of the corresponding developing device 12 when passing through between the photosensitive element 10 and the developing device 12.

A driving device (not shown) rotates one of the plurality of rollers 4, 5, and 6, over which the intermediate transfer belt 3 is looped, counterclockwise, thereby causing the intermediate transfer belt 3 to run counterclockwise as indicated by an arrow shown in FIG. 1, by which the other rollers are rotated.

A yellow toner image formed by the image forming unit 8Y that includes the developing device 12 containing the yellow toner is transferred by the transfer roller 14 onto the intermediate transfer belt 3 that is running as described above.

A cyan toner image, a magenta toner image, and a black toner image formed by the image forming units 8C, 8M, and 8K are sequentially transferred onto the transferred yellow toner image by the transfer rollers 14 to be overlaid one another. A full-color toner image is formed on the surface of the intermediate transfer belt 3 in this manner.

The cleaning devices 13 remove residual toner sticking to the surfaces of the photosensitive elements 10, from which the toner images have been transferred, from the photosensitive elements 10. Subsequently, electrostatic dischargers (not shown) neutralize the surfaces to thereby reset the surface potential for next image formation.

The recording medium 19 fed from the paper cassette 2 is delivered onto the conveying path, and conveyed by a pair of registration rollers 24 arranged on a paper-feed side, or upstream, relative to the secondary transfer roller 20 at appropriate paper feeding timing to the position where the roller 6 and the secondary transfer roller 20 face each other.

At this position, a transfer bias that is opposite in polarity to the polarity of the charged toner images on the surface of the intermediate transfer belt 3 is applied to the secondary transfer roller 20, so that the toner images on the intermediate transfer belt 3 are transferred onto the recording medium 19 at a time.

The recording medium 19 onto which the toner images are transferred is conveyed to the fixing device 30. The toner images are fused and fixed by heat and pressure applied to the recording medium 19 when passing through the fixing device 30.

When the toner images have been fixed onto the recording medium 19, the recording medium 19 is at a terminal end of the conveying path. The recording medium 19 is then conveyed to an output section 23 formed in a top portion of the apparatus main body 1*a*, and discharged onto a stacking section 25 in the top portion of the apparatus main body 1*a*.

The belt cleaning device 21 removes toner left on the intermediate transfer belt 3 after the toner images have been transferred onto the recording medium 19.

Described above is the image forming operation for forming a full-color image on the recording medium 19. Alternatively, a mono-color image can be formed using any one of the image forming units 8Y, 8C, 8M, and 8K; or further alternatively, a two-color or three-color image can be formed.

Monochrome printing using the printer according to the present embodiment can be performed by causing the photosensitive element 10 of only the image forming unit 8K to form an electrostatic latent image and develop the image, transferring the developed image onto the recording medium 19, and fixing the image using the fixing device 30.

Figure 2:
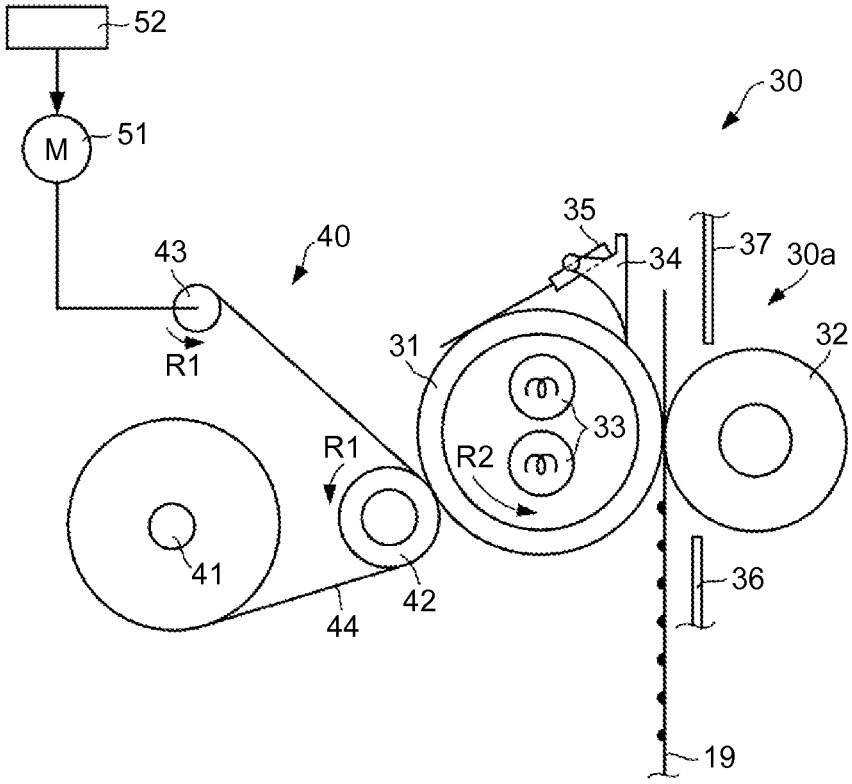
FIG. 2 is a side view of a fixing device of the image forming apparatus according to the embodiment.

FIG. 2 is a schematic configuration diagram illustrating a configuration of the fixing device 30. Referring to FIG. 2, the fixing device 30 according to the present embodiment includes a fixing roller 31 to be heated by a heater 33 and a pressure-applying roller 32 to be brought into pressure contact with the fixing roller 31. The fixing device 30 also includes a fixing section 30*a* where the fixing roller 31 and the pressure-applying roller 32 nip the recording medium 19 therebetween to fix toner onto the recording medium 19 and a cleaning section 40 that cleans the surface of the fixing roller 31. The fixing roller 31 functions as a heating roller that applies heat to the recording medium 19.

Arranged around the fixing roller 31 are a separating claw 34 that prevents the recording medium 19 from becoming entangled on the fixing roller 31 and a temperature sensor 35, such as a thermistor, that detects a surface temperature of the fixing roller 31. The heater 33 built in the fixing roller 31 is controlled based on the temperature detected by the temperature sensor 35.

The fixing roller 31 is driven by a driving device (not shown) to rotate counterclockwise R2 illustrated in FIG. 2, by which the pressure-applying roller 32 is rotated clockwise.

When the recording medium 19 carrying thereon a toner image is nipped between the rotating fixing roller 31 and the rotating pressure-applying roller 32, the toner image is fused by heat and pressure, and fixed onto the surface of the recording medium 19.

An entry guide 36 arranged at an inlet of the fixing device 30 and an exit guide 37 arranged at an exit of the fixing device 30 guide the recording medium 19.

In the process of the fixing operation described above, the fixing roller 31 contacts the toner image on the recording medium 19. Accordingly, various measures to reduce toner moving (offset) are applied to the surface of the fixing roller 31.

However, it is inevitable that minuscule toner moving onto the fixing roller 31 occurs. When an amount of moved toner is large, the toner can contaminate the recording medium 19 by adhering onto the surface of the recording medium 19 again, thereby degrading image quality.

To prevent this, the cleaning section 40 removes toner moved onto the fixing roller 31.

Figure 3:
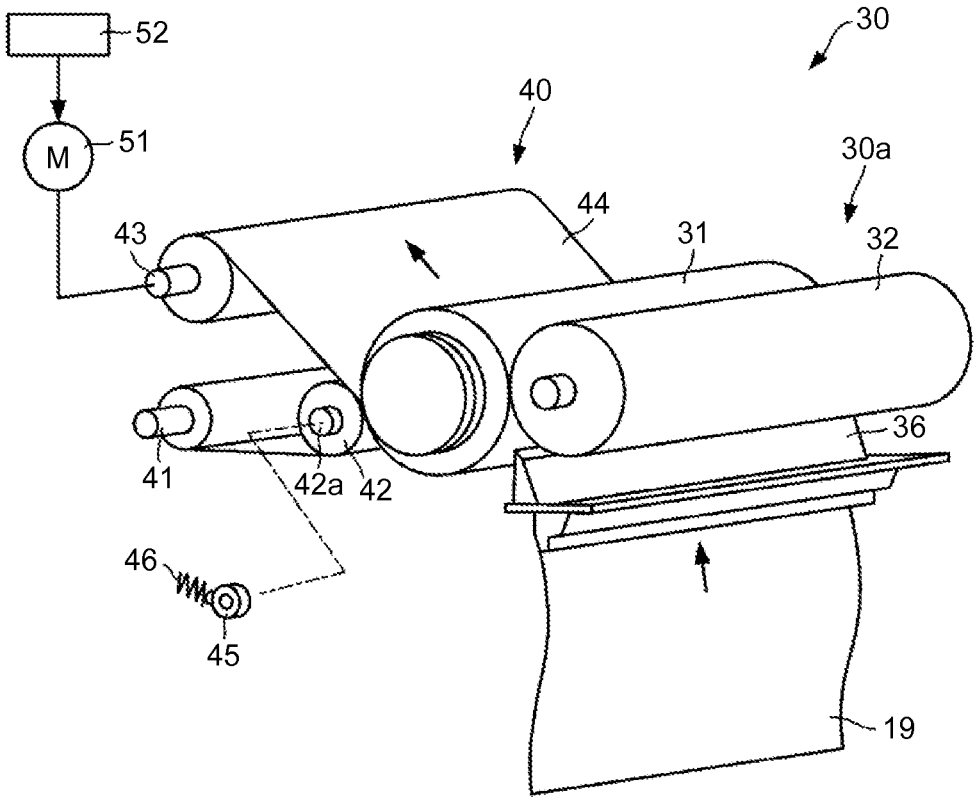
FIG. 3 is a perspective view of the fixing device of the image forming apparatus according to the embodiment.

Referring to FIGS. 2 and 3, the cleaning section 40 includes a flexible cleaning web 44, a supply core 41 on which the cleaning web 44 is wound, a pressing roller 42 that presses an unwound portion of the cleaning web 44 against the fixing roller 31, and a take-up core 43 on which the unwound cleaning web 44 is to be taken up.

The supply core 41, the pressing roller 42, and the take-up core 43 are rotatably supported on side plates (not shown) of the fixing device 30, for example.

The pressing roller 42 is configured so as to receive a pressure generated by a pressure-applying member 46 to be pressed against the fixing roller 31. In the present embodiment, a compression spring is used as the pressure-applying member 46.

The cleaning web 44 can be an elongated member formed of any appropriate material such as cloth, paper, a plastic sheet, a plastic film, or metal foil. In the present embodiment, the cleaning web 44 is an elongated nonwoven cloth formed of a material, such as a mixture of aramid and polyethylene terephthalate (PET) fibers, that can be impregnated with oil. This is because the cleaning web 44 is preferably configured to clean a peripheral surface of the fixing roller 31 by making sliding contact therewith and also to apply oil, as a releasing agent, onto the peripheral surface of the fixing roller 31.

The cleaning web 44 applies a light, uniform coating of oil onto the peripheral surface of the fixing roller 31 with the oil absorbed and retained in the cleaning web 44 during the sliding contact with the peripheral surface of the fixing roller 31.

Silicone oil or the like can preferably be used as this oil to inhibit toner offset onto the peripheral surface of the fixing roller 31, to increase lubricating property of the peripheral surface, and to prevent wear on the peripheral surface.

The cleaning web 44 is fixed at its one end to the take-up core 43. One end of the take-up core 43 is in driving connection with a motor 51. The motor 51 is under driving control of a controller 52.

A DC motor or a stepping motor can be used as the motor 51. When a DC motor is used as the motor 51, the controller 52 controls running time of the motor 51, thereby controlling the number of rotations of the take-up core 43 and, accordingly, controlling a length of the cleaning web 44 to be fed (hereinafter, "feeding length"). When a stepping motor is used as the motor 51, the controller 52 controls the number of pulses sent to the motor 51, thereby controlling the number of rotations of the take-up core 43 and, accordingly, controlling the feeding length of the cleaning web 44.

In the cleaning section 40 illustrated in FIG. 3, a one-way clutch (now illustrated) held by a retaining member 45 rotatably supports a roller shaft 42*a* jutting from opposite ends of the pressing roller 42 and allows the pressing roller 42 to rotate only in one direction.

When this configuration in which the one-way clutch rotatably supports the roller shaft 42*a* and allows rotation only in the one direction R1 as illustrated in FIG. 2 is employed, because the function as a bearing and the function as a one-way clutch are integrated (unified), considerably-high compactness can be achieved, and advantages of space saving and cost reduction are obtained.

The present inventors have found that in the fixing device 30 configured as described above, because oil seeps from an outer-radius portion of the cleaning web 44 wound on the supply core 41 in a roll form toward a center of the same, an amount of oil absorbed and retained in a portion of the cleaning web 44 within 0.5 m from a leading end of the cleaning web 44 is 10% to 20% smaller than a lower threshold of a target range.

Figure 5A:
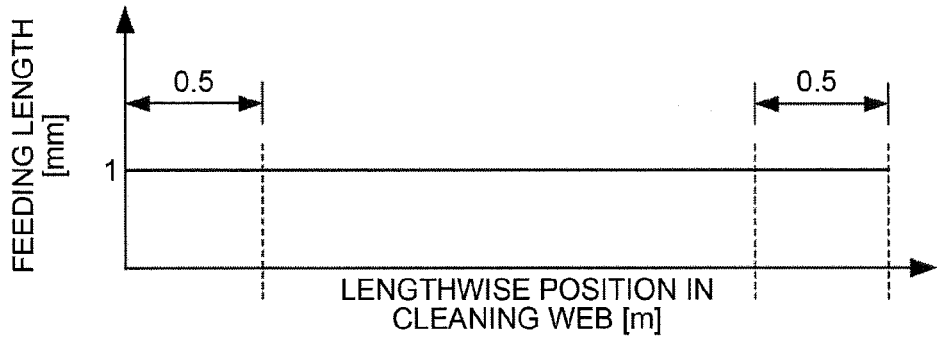
FIG.5A (Conventional Art)
FIG. 5A is a plot of dispensing length of a cleaning web versus lengthwise position in the cleaning web of a conventional fixing device.

However, according to conventional control of a feeding length of the cleaning web 44, the feeding length in one feeding is set to a fixed value, e.g., 1 mm, whichever portion of the cleaning web 44 is fed as illustrated in FIG. 5A. Accordingly, an amount of oil applied to the surface of the fixing roller 31 from a leading portion of the cleaning web 44 within 0.5 m from the leading end is 10% to 20% smaller than the lower threshold of the target range, and therefore the amount of oil fails to fall within the target range. As a result, toner offset onto the surface of the fixing roller 31 occurs, undesirably resulting in contamination of an image.

Furthermore, the toner moved by the toner offset onto the surface of the fixing roller 31 is accumulated on the temperature sensor 35 that comes into contact with the fixing roller 31, resulting in a damage on a surface layer of the fixing roller 31.

Figure 5B:
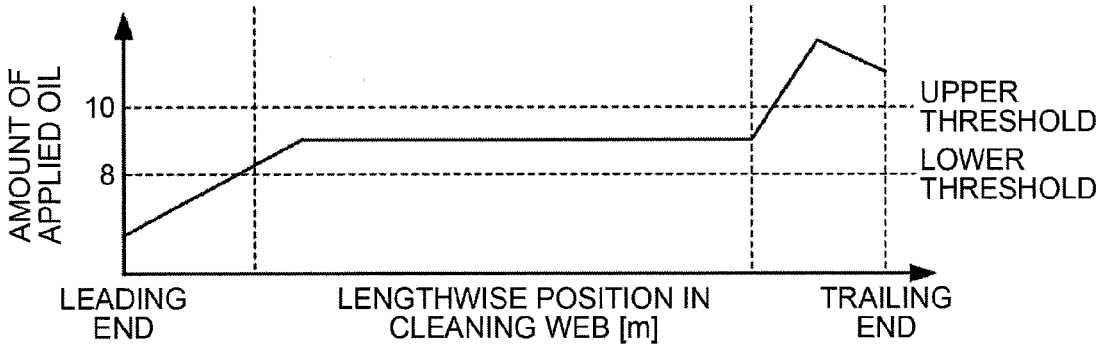
FIG.5B (Conventional Art)
FIG. 5B is a plot of amount of applied oil versus lengthwise position in the cleaning web of a conventional fixing device.

Similarly, an amount of oil in a trailing portion of the cleaning web 44 within 0.5 m from the trailing end of the cleaning web is 10% to 20% larger than the upper threshold of the target range. Accordingly, because a relatively large amount of oil is applied to the surface of the fixing roller 31, toner escaping or the like occurs, which results in contamination of an image. The target range of the oil amount is the range between the upper threshold and the lower threshold illustrated in FIG. 5B.

In the present embodiment, the controller 52 controls the feeding length of the cleaning web 44 to the fixing roller 31 as follows. When a normal portion of the cleaning web 44 excluding the leading portion within 0.5 m from the leading end and the trailing portion within 0.5 m from the trailing end is fed, the controller 52 controls a feeding length in one feeding of the cleaning web 44 per print job of 18 to 20 sheets to 1 mm. However, as described below, when the leading portion of the cleaning web 44 within 0.5 m from the leading end or the trailing portion of the cleaning web 44 within 0.5 m from the trailing end is fed, the controller 52 increases or decreases the feeding length in one feeding relative to the normal feeding length, which is 1 mm.

Figure 4A:
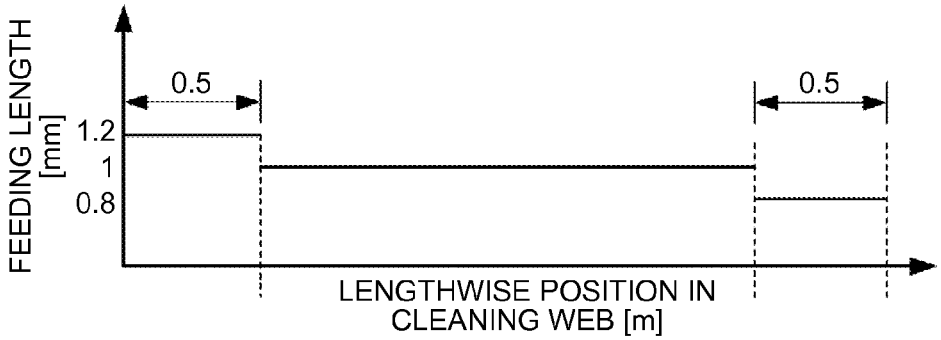
FIG. 4A is a plot of feeding length of a cleaning web versus lengthwise position in the cleaning web of the fixing device of the image forming apparatus according to the embodiment.

As illustrated in FIG. 4A, when the leading portion within 0.5 m from the leading end of the cleaning web 44 is fed, the controller 52 increases the feeding length in one feeding per print job of 18 to 20 sheets to 1.2 mm relative to the normal feeding length, or 1 mm.

Figure 4B:
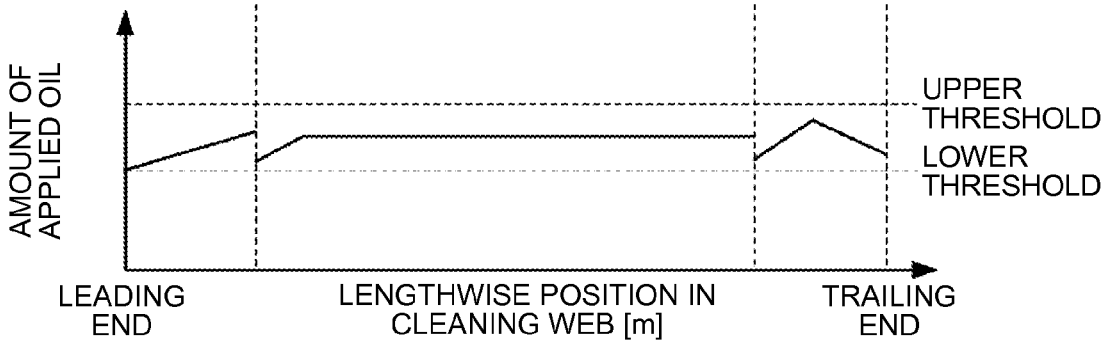
FIG. 4B is a plot of amount of applied oil versus lengthwise position in the cleaning web of the fixing device of the image forming apparatus according to the embodiment.

By increasing the feeding length of the cleaning web 44 from the normal feeding length, or 1 mm, to 1.2 mm, oil of which amount falls within the target range can be applied to the fixing roller 31 as illustrated in FIG. 4B, and therefore the anti-adhesion properties can be equalized across the surface of the fixing roller 31.

As a result, poor cleaning of the surface of the fixing roller 31 and occurrence of toner offset onto the surface of the fixing roller 31 can be prevented. Meanwhile, the feeding length in one feeding is a minuscule length of the cleaning web 44 to be fed per print job of 18 to 20 sheets.

As illustrated in FIG. 4A, when the trailing portion of the cleaning web 44 within 0.5 m from the trailing end is fed, the controller 52 decreases the feeding length in one feeding to 0.8 mm relative to the normal feeding length, or 1 mm.

By decreasing the feeding length of the cleaning web 44 in one feeding from the normal feeding length, or 1 mm, to 0.8 mm, oil of which amount falls within the target range can be applied to the fixing roller 31 as illustrated in FIG. 4B, and therefore the anti-adhesion properties can be equalized across the surface of the fixing roller 31.

Because an excessive amount of oil is not applied to the surface of the fixing roller 31 any more, contamination of an image resulting from toner escaping or the like can be reduced.

As illustrated in FIG. 4A, when the normal portion excluding the leading portion within 0.5 m from the leading end and the trailing portion within 0.5 mm from the trailing end is fed, the controller 52 controls the feeding length of the cleaning web 44 per print job of 18 to 20 sheets to 1 mm.

An amount of oil absorbed and retained in the cleaning web 44 is neither excessive nor deficient in the normal portion excluding the portion near the leading end and the portion near the trailing end. Accordingly, oil of which amount falls within the target range can be applied to the fixing roller 31 as illustrated in FIG. 4B, and therefore the anti-adhesion properties can be equalized across the surface of the fixing roller 31.

Meanwhile, when the overall length of the cleaning web 44 is 32 m, each of the leading portion within 0.5 m from the leading end and the trailing portion within 0.5 m from the trailing end of the cleaning web 44 occupies 1.5% of the overall length. To reliably equalize the anti-adhesion properties across the surface of the fixing roller 31 by applying oil of which amount falls within the target range to the fixing roller 31, it is preferable that each of the portion near the leading end and the portion near the trailing end of the cleaning web 44 on which the control of increasing or decreasing the feeding length is performed occupies 2% of the overall length.

As described above, in the fixing device 30 according to the present embodiment, the controller 52 causes the take-up core 43 to rotate in such a manner that, when the leading portion extending up to 2% of the overall length of the cleaning web 44 from the leading end of the cleaning web 44 is fed, the feeding length in one feeding is 20% larger than when the subsequent portion of the cleaning web 44 is fed.

With this configuration, because oil of which amount falls within the target range can be applied to the fixing roller 31 by increasing the feeding length of the cleaning web 44 by 20%, the anti-adhesion properties can be equalized across the surface of the fixing roller 31.

In the fixing device 30 according to the present embodiment, the controller 52 causes the take-up core 43 to rotate in such a manner that, when the trailing portion extending up to 2% of the overall length of the cleaning web 44 from the trailing end of the cleaning web 44 is fed, the feeding length of the cleaning web 44 in one feeding is 20% smaller than when the previous portion of the cleaning web 44 is fed.

With this configuration, because oil of which amount falls within the target range can be applied to the fixing roller 31 by decreasing the per-supply dispensing length of the cleaning web 44 by 20%, the anti-adhesion properties can be equalized across the surface of the fixing roller 31.

Although the preferred embodiments of the present invention have been described above, the present invention is not limited to the embodiments.

For example, the fixing device 30 according to the present embodiment is what is referred to as a roller-type fixing device that includes the fixing roller 31 and the pressure-applying roller 32. Alternatively, the fixing device 30 may be what is referred to as a belt-type fixing device that uses a fixing belt in lieu of the pressure-applying roller 32.

A fixation-related member to be cleaned by the cleaning device is not limited to the fixing roller 31, but can be the pressure-applying roller 32 or the fixing belt. The amount by which the feeding length in one feeding is to be changed for the portion of the cleaning web 44 extending up to 2% of the overall length from the leading end (or the trailing end) is not limited to a specific value, or 20% described above, but can be a range of at least 10% and no more than 30% or a range of at least 15% and no more than 25%.

According to an aspect of the present invention, it is possible to equalize anti-adhesion properties across a surface of a fixing roller whichever portion of a cleaning web is fed to clean the surface.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a fixing unit that includes a pair of nipping members that are in pressure contact with each other, and a heat source that heats at least one of the pair of nipping members, and fixes toner onto a recording medium with heat and pressure by nipping the recording medium between the pair of nipping members;

a cleaning unit that includes a cleaning web wound on a supply core to be supplied from the supply core and taken up on a take-up core, and a pressing roller that is pressed by a pressure-applying member against one of the pair of nipping members, and brings the cleaning web into contact with one of the pair of nipping members using the pressing roller, thereby cleaning the one of the pair of nipping members; and a controller that causes the take-up core to rotate in accordance with the number of sheets of the recording medium passed through between the pair of nipping members to feed the cleaning web from the supply core, wherein the controller causes the take-up core to rotate in such a manner that, when a leading portion of the cleaning web extending up to 2% of an overall length of the cleaning web from a leading end of the cleaning web is fed, a length of the cleaning web to be fed in one feeding is 10-30% larger than when a subsequent portion of the cleaning web is fed.

2. The fixing device according to claim 1, wherein the controller causes the take-up core to rotate in such a manner that, when the leading portion of the cleaning web is fed, the length of the cleaning web to be fed in one feeding is 15-25% larger than when the subsequent portion of the cleaning web is fed.

3. An image forming apparatus comprising the fixing device according to claim 1.

4. The fixing device according to claim 1, wherein the cleaning web applies a light, uniform coating oil onto a peripheral surface of one of the pair of nipping members.

5. The fixing device according to claim 1, wherein one end of the take-up core is in a driving connection with a motor.

6. The fixing device according to claim 5, wherein the motor is a stepping motor.

7. The fixing device according to claim 6, wherein the controller controls a number of pulses sent to the stepping motor so as to control a number of rotations of the take-up core and control the feeding lengths of the cleaning web.

8. The fixing device according to claim 1, further comprising a retaining member to support a roller shaft and allow rotation only in one direction.

9. A fixing device comprising:

a fixing unit that includes a pair of nipping members that are in pressure contact with each other, and a heat source that heats at least one of the pair of nipping members, and fixes toner onto a recording medium with heat and pressure by nipping the recording medium between the pair of nipping members;

a cleaning unit that includes a cleaning web wound on a supply core to be supplied from the supply core and taken up on a take-up core, and a pressing roller that is pressed by a pressure-applying member against one of the pair of nipping members, and brings the cleaning web into contact with one of the pair of nipping members using the pressing roller, thereby cleaning the one of the pair of nipping members; and a controller that causes the take-up core to rotate in accordance with the number of sheets of the recording medium passed through between the pair of nipping members to feed the cleaning web from the supply core, wherein the controller causes the take-up core to rotate in such a manner that, when a trailing portion of the cleaning web extending up to 2% of an overall length of the cleaning web from a trailing end of the cleaning web is fed, a length of the cleaning web to be fed in one feeding is 10-30% smaller than when a previous portion of the cleaning web is fed.

10. The fixing device according to claim 9, wherein the controller causes the take-up core to rotate in such a manner that, when the trailing portion of the cleaning web extending up to 2% of the overall length from the trailing end is fed, the length of the cleaning web to be fed in one feeding is 15-25% smaller than when the previous portion of the cleaning web is fed.

11. An image forming apparatus comprising the fixing device according to claim 9.

12. The fixing device according to claim 9, wherein the cleaning web applies a light, uniform coating oil onto a peripheral surface of one of the pair of nipping members.

13. The fixing device according to claim 9, wherein one end of the take-up core is in a driving connection with a motor.

14. The fixing device according to claim 13, wherein the motor is a stepping motor.

15. The fixing device according to claim 14, wherein the controller controls a number of pulses sent to the stepping motor so as to control a number of rotations of the take-up core and control the feeding lengths of the cleaning web.

16. The fixing device according to claim 9, further comprising a retaining member to support a roller shaft and allow rotation only in one direction.

* * * * *